US005612655A

United States Patent [19]

Stronks et al.

[11] Patent Number: 5,612,655

[45] Date of Patent: Mar. 18, 1997

[54] FILTER ASSEMBLY COMPRISING A PLASTIC RESONATOR SUPPORT AND RESONATOR TUNING ASSEMBLY

[75] Inventors: John Stronks; Erik Lilieholm; Johnny Gee, all of Reno, Nev.

[73] Assignee: Allen Telecom Group, Inc., Solon, Ohio

[21] Appl. No.: 498,629

[22] Filed: Jul. 6, 1995

[51] Int. Cl.[6] ..... H01P 1/20

[52] U.S. Cl. ..... 333/202; 333/219.1; 333/235

[58] Field of Search ..... 333/202, 219.1, 333/227, 231, 235

[56] References Cited

U.S. PATENT DOCUMENTS

| | | | |
|---|---|---|---|
| 4,121,181 | 10/1978 | Nishikawa et al. | 333/202 |
| 4,477,788 | 10/1984 | Collinet et al. | 333/202 X |
| 4,500,859 | 2/1985 | Ren et al. | 333/231 X |
| 4,728,913 | 3/1988 | Ishikawa et al. | 333/202 X |
| 5,329,687 | 7/1994 | Scott et al. | 333/202 X |

*Primary Examiner*—Benny T. Lee

*Assistant Examiner*—Justin P. Bettendorf

*Attorney, Agent, or Firm*—Laff, Whitesel, Conte & Saret, Ltd.

[57] ABSTRACT

A filter including a cavity, a resonator structure and having a plastic resonator support and plastic tuning assembly suitable for both manual and automatic tuning applications. The dielectric resonator structure comprises a substantially cylindrical ceramic resonator, and a plastic support having a plurality of spaced apart elements diverging from a shoulder of the plastic support, each of the elements terminating in a cantilevered stop, the cantilevered stops holding the ceramic resonator in a fixed relationship with respect to the plastic support and the cavity. A resonator tuning assembly is provided that comprises a substantially cylindrical ceramic tuning element and a plastic tuning shaft having a coupling means at a first end and being threaded along a portion of its length. A ceramic tuning element is affixed to the shaft at a second end. A substantially cylindrical tuning cap is threadably engaged with the plastic tuning shaft, such that rotational motion of the tuning shaft within the tuning cap results in linear motion of the tuning element with respect to the tuning cap.

16 Claims, 5 Drawing Sheets

FILTER ASSEMBLY COMPRISING A PLASTIC RESONATOR SUPPORT AND RESONATOR TUNING ASSEMBLY

FIELD OF THE INVENTION

This invention relates generally to a resonator support and in particular to a plastic resonator support for a ceramic resonator in a microwave cavity, and is more particularly directed toward a plastic resonator support compatible with a plastic resonator tuning assembly usable for both manual and automatic resonator tuning.

BACKGROUND OF THE INVENTION

The normal methods for supporting a ceramic resonator in a microwave cavity are expensive to manufacture and fabricate. These methods also lead to manufacturing and production difficulties.

The typical methods are forming the support as part of the ceramic resonator, bonding the support to the ceramic, and sandwiching the ceramic in the cavity by the use of two supports. When the support is formed as a part of the ceramic resonator, the support structure is, of course, also ceramic, but is high cost and provides, at times, spurious responses, leading to problems with performance. If the support structure is bonded to the resonator, the support is often a quartz stem that is compression fit against the resonator. This process is expensive and can also affect reliability.

All of these methods provide a less than optimal solution. They are expensive and have numerous manufacturing and production deficiencies.

Accordingly, a need arises for a resonator support technique that is durable enough to withstand a useful range of operating conditions, while still being relatively economical to manufacture and install. In addition, the mounting technique should permit the resonator to be tuned with relative ease, whether through a manual or automatic approach.

SUMMARY OF THE INVENTION

These needs and others are satisfied by the present invention, in which a filter assembly comprises a cavity, a substantially cylindrical dielectric resonator supported in the cavity, a fiber filled plastic support structure, and a support surface defined by the support structure, the resonator being supported against and bearing against the support surface. The support structure further comprises a clamping means, the clamping means engaging a surface of the resonator remote from the support surface and maintaining the resonator against the support surface, the support structure further comprising an attachment means for fixedly positioning the support structure in the cavity. In this manner, the resonator remains substantially stationary with respect to the support surface and the cavity over the operating temperature range of the filter. Preferably, the resonator is a ceramic resonator.

The plastic support structure clamping means may comprise a plurality of spaced apart arms diverging from the support surface thereof, each of the arms terminating in a cantilevered stop at a first end, with the cantilevered stops holding the dielectric resonator in a fixed relationship with respect to the support surface. The resonator may have an axial opening therethrough, in which case the spaced apart arms cooperate with the axial opening such that the spaced apart arms are deformed toward one another upon entering a proximal end of the opening, then move away from one another as the cantilevered stops exit a distal end of the opening. A resilient 0-ring is desirably interposed between the support surface and the resonator. Preferably, the plastic support structure is formed from a high temperature fiber filled thermoplastic, such as a glass fiber filled polyetherimide resin. The glass fiber filled polyetherimide resin is desirably adjusted to provide a selected temperature coefficient of expansion of the plastic support structure.

The filter may further include a resonator tuning assembly comprising a substantially cylindrical dielectric tuning element, an elongated plastic tuning shaft mounted for movement axially of its length and having a gripping means at one end for gripping and mounting the tuning element, and wherein the plastic tuning shaft and the tuning element are mounted for movement within the plastic support structure to vary the resonant frequency of the filter. In one form, the plastic tuning shaft is threaded along a portion of its length, and has a plurality of spaced apart members diverging from a shoulder of the plastic tuning shaft, each of the members terminating in a cantilevered stop, the cantilevered stops holding the tuning element in a fixed relationship with respect to the plastic tuning shaft, and a substantially cylindrical tuning cap threadably engaged with the plastic tuning shaft, such that rotational motion of the tuning shaft within the tuning cap results in axial motion of the tuning element with respect to the tuning cap.

The tuning element may have an axial opening therethrough and the spaced apart members cooperate with the axial opening such that the spaced apart members are deformed toward one another upon entering a proximal end of the opening, then move away from one another as the cantilevered stops exit a distal end of the opening. A locking nut is desirably threadably engaged with the tuning shaft in proximity to the tuning cap, the locking nut being rotated to move into contact with the tuning cap and frictionally preventing further rotation of the tuning shaft with respect to the tuning cap when a desired tuning element position has been reached. A knurled flattened head is desirably provided for imparting rotational motion to the tuning shaft. The plastic tuning shaft is preferably formed from a glass fiber reinforced polyetherimide resin, and the glass fiber content of the glass fiber reinforced polyetherimide resin is adjusted to provide a selected temperature coefficient of expansion of the plastic tuning shaft.

BRIEF DESCRIPTION OF THE DRAWINGS

FIG. 1(*b*) is a side sectional view of the ceramic resonator taken along section line 1(*b*) —1(*b*) of FIG. 1(*a* );

FIG. 3(*b*) is a rotated side elevational view of the plastic resonator support of FIG. 3(*a* );

FIG. 3(*c*) is an end elevational view of the plastic resonator support in accordance with the present invention;

FIG. 6(*b*) is a side sectional view of the resonator of FIG. 6(*a* ) taken along section line 6(*b*)—6(*b*) of FIG. 6(*a* );

FIG. 9(*b*) is a side sectional view of the resonator tuning assembly of FIG. 9(*a* ) taken along section line 9(*b*)—9(*b*) of FIG. 9(*a*)

DETAILED DESCRIPTION OF THE INVENTION

A plastic resonator support and resonator tuning assembly that avoid the shortcomings of support structures and tuning systems of the prior art can best be understood with reference to the accompanying drawing figures.

Figure 1A:
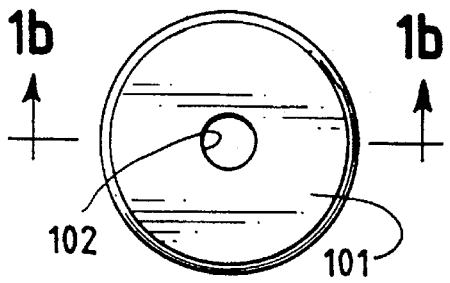
FIG. 1(*a*) is a top view of a ceramic resonator.
Figure 1B:
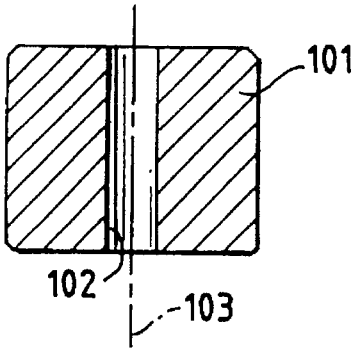

FIG. 1(*a* ) is a top view of a substantially cylindrical ceramic resonator 101 formed from a typical low-loss, high dielectric constant ceramic material of a type well-known in the dielectric resonator art. Preferably, the material is primarily barium titanate. The ceramic resonator 101 has an opening 102 that extends completely through the resonator 101.

FIG. 1(*b*) is a side sectional view of the ceramic resonator 101 taken along section line 1(*b*)—1(*b*) of FIG. 1(*a* ). As can be seen in FIG. 1(*b*), the opening 102 through the resonator 101 is an axial opening, extending along the resonator axis 103.

Figure 2:
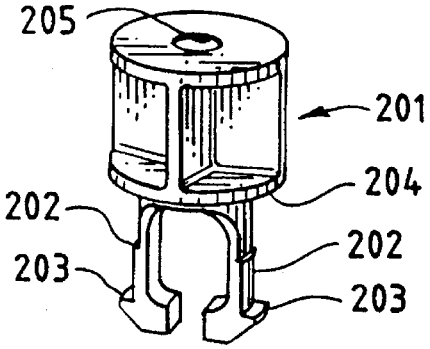
FIG. 2 is a perspective view, on an enlarged scale, of one embodiment of a plastic resonator support in accordance with the present invention.
Figure 4:
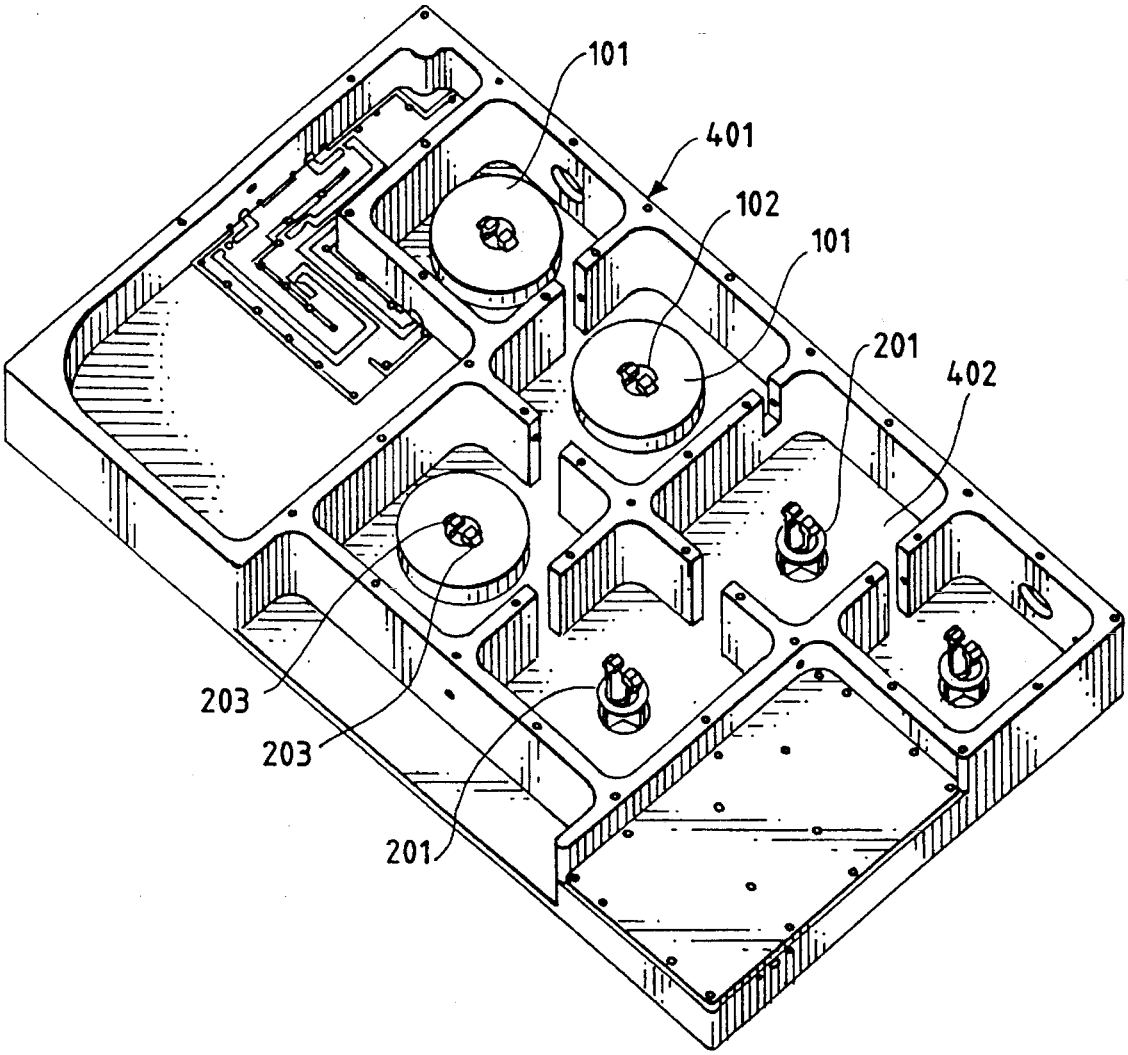
FIG. 4/is a perspective view of a multiple resonator assembly.

FIG. 2 is a perspective view, on an enlarged scale, of a fiber filled plastic resonator support 201 designed for mounting and supporting the ceramic resonator 101 of FIGS. 1(*a* ) and 1(*b*) in a cavity (see FIG. 4). The plastic support 201 is constructed by injection molding a high-temperature low loss thermoplastic compound, preferably a glass fiber reinforced polyetherimide resin such as ULTEM 2300, available from GE Plastics, One Plastics Avenue, Pittsfield, Mass.

The plastic support 201 is provided with a plurality of spaced apart elements such as arms 202 that diverge from a support surface or shoulder 204 of the plastic support upon which the resonator is supported and against which it bears. In the preferred embodiment, there are two of these arms 202, although a larger number could also be used. Each of the arms 202 terminates in a cantilevered clamping means or stop 203, whose purpose will be described subsequently. The plastic support 201 also includes a provision for attachment of the plastic support 201 to a support surface for fixedly positioning the support structure in the cavity. In the preferred embodiment, this provision takes the form of a mounting hole 205 designed to accommodate a screw for securing the support. Other attachment provisions may be equally workable.

Figure 3A:
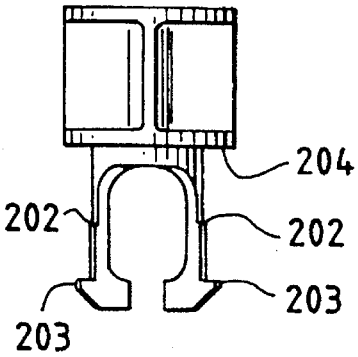
FIG. 3(*a*) is a side elevational view of the plastic resonator support.
Figure 3B:
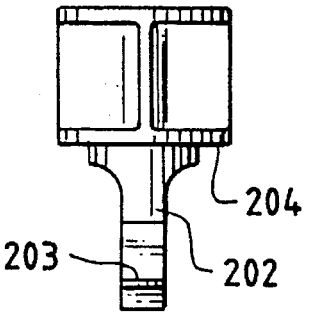
Figure 3C:
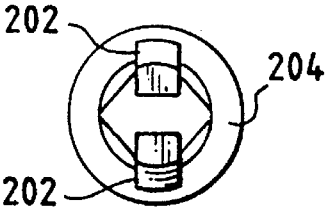

FIG. 3(*a* ) is a side elevational view of the plastic support 201, and illustrates more clearly the divergence of the arms 202 at the shoulder 204 of the plastic support, and the preferred shape of the cantilevered stops 203.

FIG. 4 is a perspective view of a multiple filter and resonator assembly 401 in which a plurality of resonators 101 is installed, one in each of a plurality of cavities. As can be appreciated from an examination of FIG. 4, the plastic supports 201 are attached, via mounting screws and holes 205, to an interior support surface 402 of the assembly. In order to install a resonator 101, the opening 102 in the resonator 101 is aligned with the spaced apart arms (202 in FIG. 2) and the resonator 101 is pressed downward until the arms begin to enter a proximal end of the opening. This contact with the opening cams and deforms the arms toward one another until the opening 102 envelops the cantilevered stops 203. Under continuous downward pressure, the resonator 101 settles onto the plastic support 201 until the cantilevered stops begin to protrude from the distal end of the opening. Preferably, this substantially coincides with the resonator 101 making contact with the shoulder 204 from which the arms 202 diverge. At this point, the cantilevered stops 203 protrude fully from the distal end of the opening 102, and the arms 202 move away from one another, allowing the cantilevered stops to bear against the outer surface of the resonator, to clamp and hold the resonator 101 in a fixed stationary relationship with respect to the shoulder 204 and the plastic support 201, as well as with respect to the cavity, all over the operating temperature range of the filter.

Of course, all that is necessary for support of the resonator 101 is a gripping means associated with the plastic support 201. Instead of penetrating an opening 201 provided in the resonator 101, a gripping structure in the form of a basket, having supporting arms that diverge from a shoulder of the plastic support 201 in such a way that the arms can envelop the resonator 101, may be provided. Cantilevered stops can still hold the resonator firmly in place by making contact with the top of the resonator 101 near the resonator circumference.

Figure 5:
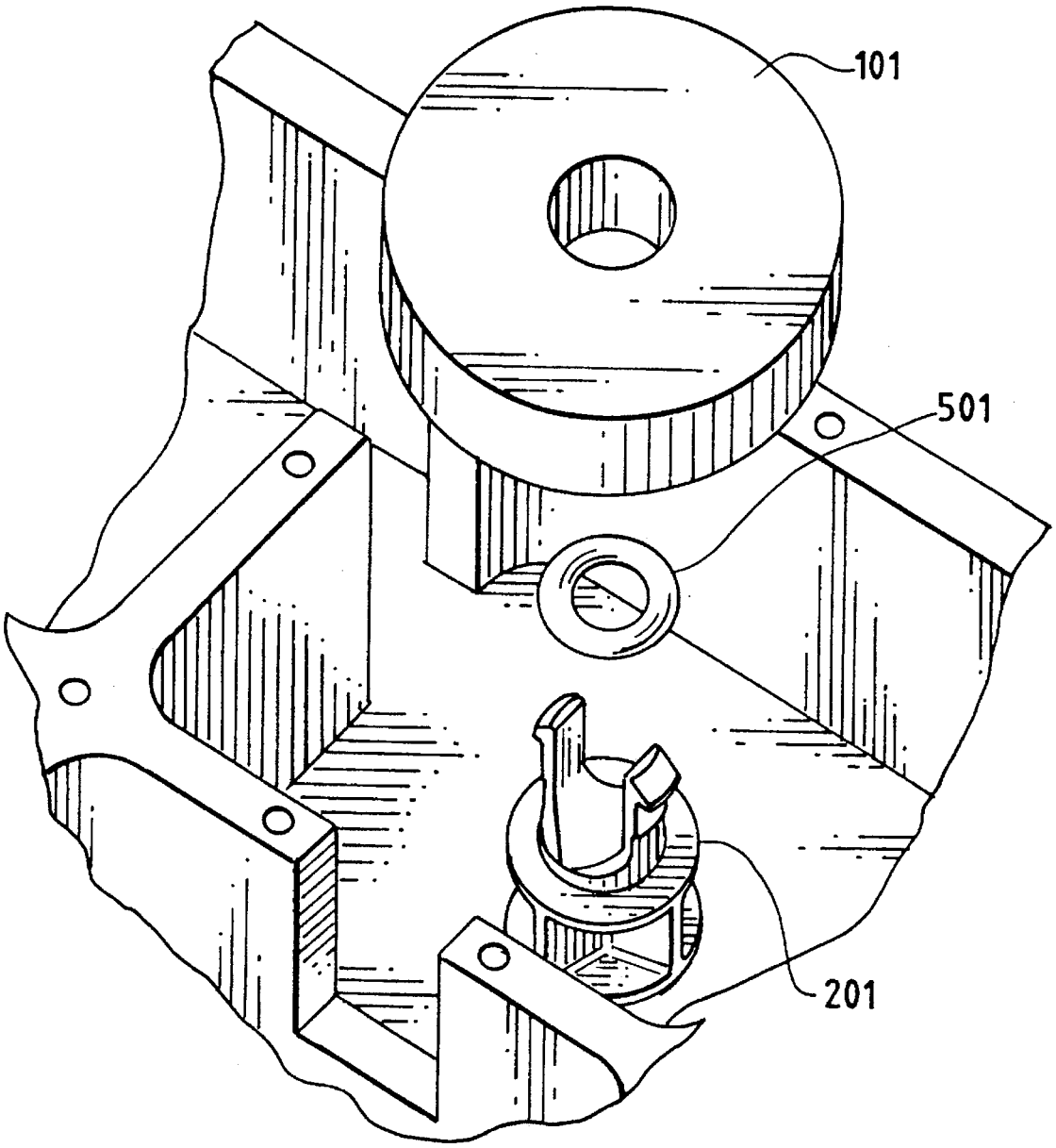
FIG. 5 is a modification of a portion of FIG. 4.

FIG. 5 is a modification of a portion of FIG. 4 that illustrates the use of a resilient 0-ring 501, preferably formed from a silicone rubber, interposed between the ceramic resonator 101 and the shoulder 204 of the plastic support 201. The silicone 0-ring 501 under compression is used to hold the ceramic resonator 101 firmly in place relative to the plastic support while minimizing tolerance problems, also to maintain the resonator stationary with respect to the support surface and the cavity over the operating temperature range of the resonator.

Figure 6A:
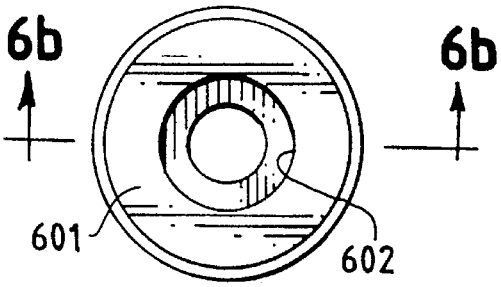
FIG. 6(*a*) is a top view of a ceramic resonator.
Figure 6B:
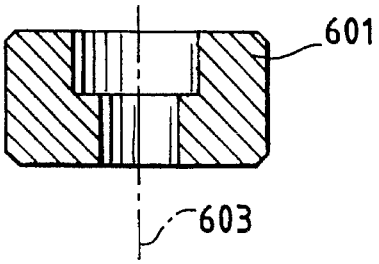

Another embodiment of the plastic resonator support structure is designed for use with a ceramic resonator, such as one having a stepped opening. FIG. 6(*a* ) is a top view of a ceramic resonator 601 having an opening 602 provided therethrough. The opening 602 is an axial opening along the resonator axis 603. In this instance, the stops 203 bear against a remote surface internal of the opening 602 (the stepped surface) to retain the resonator against the support surface.

Figure 7:
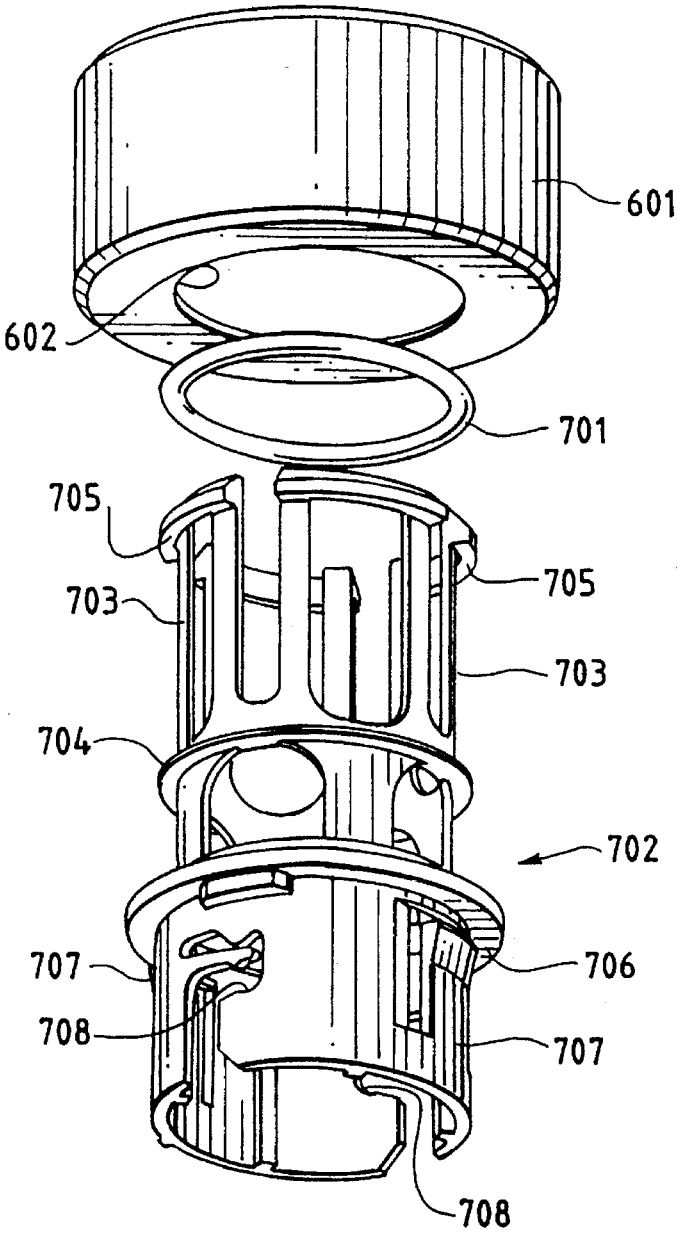
FIG. 7/ is an exploded perspective view of another embodiment of a plastic resonator support in accordance with the present/ invention.
Figure 9A:
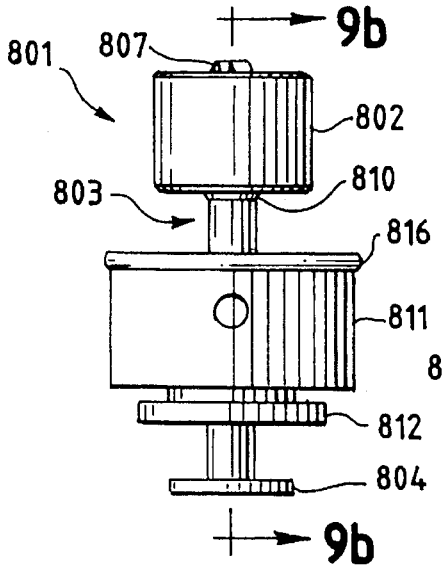
FIG. 9(*a* ) is a side elevational view of the resonator tuning assembly of FIG. 8.
Figure 9B:
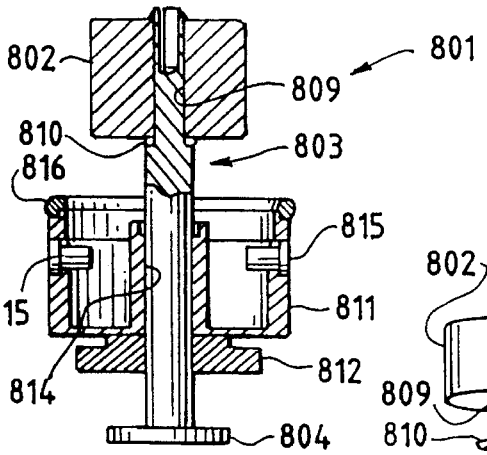

FIG. 7 is a perspective view of another embodiment of a plastic resonator support 702 in position for installation of a ceramic dielectric resonator 601. This embodiment of the plastic support 702 also includes a plurality of spaced apart elements 703 that diverge from a support surface or shoulder 704 of the plastic support 702 against which the resonator bears. In this embodiment, there are four spaced apart elements 703. Each of the spaced apart elements 703 terminates in a cantilevered stop 705 which clamps the resonator against the support surface.

This embodiment of the resonator structure assembles much as described previously. The ceramic resonator 601 is positioned such that the opening 602 in the resonator is aligned with the spaced apart elements 703 of the plastic support 702. As the elements 703 enter the opening 602, they are cammed or deformed toward one another. As the ceramic resonator 601 moves toward the shoulder 704 of the plastic support 702, the cantilevered stops 705 begin to exit from the distal end of the opening 602. At approximately the same time as the ceramic resonator 601 reaches the shoulder 704 of the plastic support 702, the cantilevered stops 705 emerge from the opening 602 and the elements 703 move away from one another, causing the cantilevered stops 705 to clampingly hold the ceramic resonator 601 in a fixed relationship with respect to the plastic support 702. Just as described previously, a resilient 0-ring 701, preferably formed from a silicone rubber, is interposed between the ceramic resonator 601 and the shoulder 704 of the plastic support 702. This silicone 0-ring 701 under compression allows the ceramic resonator 601 to be held firmly in position, acting to minimize tolerance problems and to accurately locate the resonator relative to the support surface and cavity.

Just as described previously, it is not necessary that a gripping means provided to hold the resonator 601 in place actually penetrate an opening 602 in the resonator. The gripping means could also be a basket-like structure that supports the resonator 601 by enveloping the resonator in such a way that the cantilevered stops can make contact with a remote upper surface of the resonator near the resonator circumference, thus fixing the resonator 601 in position with respect to the plastic support.

The plastic support 702 also includes an attachment provision at an end opposite from the ceramic resonator 601, for affixing the dielectric resonator structure to a supporting surface of the filter. The attachment means includes a lip 706 formed into the plastic support 702. This lip 706 is designed to be larger in diameter than an opening in the supporting surface intended to accommodate the plastic support. As the plastic support is inserted into the opening, opposed deformable members 707 are forced toward the center of the opening by points on the opening circumference with which the deformable members 707 make contact. The material from which the supporting surface is formed is just thin enough so that, when the lip 706 makes contact with one side of the supporting surface, the deformable members 707 just clear the opposing portion of the surface, and the deformable members 707 snap back into position to hold the plastic support in the opening. The plastic support 702 also accepts a resonator tuning assembly in a fashion that will now be described.

Figure 8:
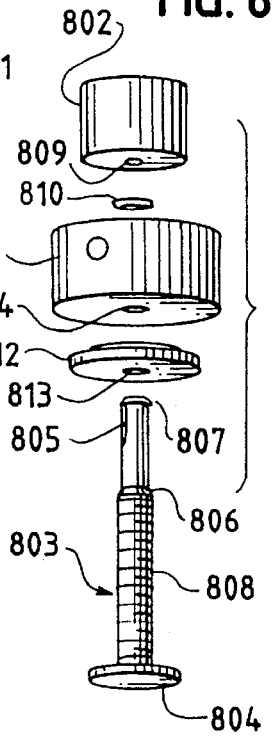
FIG. 8 is an exploded perspective view of a resonator tuning assembly in accordance with the present invention.

FIG. 8 is a perspective view of a resonator tuning assembly 801 in accordance with the present invention. The tuning assembly includes a substantially cylindrical ceramic dielectric tuning element 802 with an axially formed opening 809 therethrough. The ceramic tuning element 802, preferably formed from a low-loss, high dielectric constant ceramic material, such as barium titanate, cooperates with a fiber filled plastic tuning shaft 803 in a manner that will be described in more detail below.

The plastic tuning shaft 803 has a coupling means, such as a flattened head 804, at a first end. The tuning shaft is mounted for movement axially of its length. A gripping means is provided at a second end for gripping and mounting the tuning element. In one embodiment, the timing shaft is threaded along a portion 808 of its length, preferably extending from the head 804 to a shoulder 806 of the shaft 803. At or below the shoulder 806, a plurality of spaced apart members 805 diverge, with each of these members 805 terminating in a cantilevered stop 807 to provide the gripping means for gripping the tuning element.

In attaching the component parts of the tuning assembly 801, a locking nut 812, that has a threaded opening 813 therethrough, is threaded onto the plastic shaft 803. Next, a tuning cap 811, also provided with a threaded opening 814, is threaded onto the shaft 803. The tuning cap 811 is threaded onto the shaft 803 a sufficient distance to leave the shoulder 806 exposed.

Next, a resilient 0-ring 810, preferably of a silicone rubber, is placed on the shaft 803 until the 0-ring 810 makes contact with the shoulder 806. The spaced apart members 805 on the shaft 803 are then positioned in alignment with the axially formed opening 809 in the ceramic tuning element 802. As the tuning element 802 is moved toward the shaft 803 so that the cantilevered stops 807 enter the opening 809, the spaced apart members 805 are deformed toward one another. As the tuning element 804 is moved further toward the shaft 803, the cantilevered stops 807 exit the opening and the spaced apart members 805 move away from each other, allowing the cantilevered stops 807 to hold the tuning element 802 in a fixed relationship with respect to the shaft 803, with the tuning element 802 in contact with[4] the 0-ring 810 that has been interposed between the tuning element 802 and the shoulder 806. The 0-ring 810 is then under compression, allowing the tuning element 802 to be held firmly in position, and minimizing tolerance problems.

Of course, the ceramic tuning element could also be held in place by an alternative gripping means, such as a basket arrangement of members that envelop the tuning element and allow the cantilevered stops to make contact with a distal surface of the tuning element, near the element's circumference, to hold the tuning element firmly in place.

It should be noted that, if the tuning cap 811 is held against rotation, rotational motion of the tuning shaft 803 will result in linear motion of the tuning element 802 with respect to the tuning cap 811. The head 804 of the tuning shaft 803 may be knurled along at least a portion of its circumference to make shaft rotation easier. Once the tuning element 802 has been placed into its desired position with respect to the tuning cap 811, the locking nut 812 may be rotated until the locking nut 812 comes into contact with the tuning cap 811, thus frictionally preventing further rotation of the tuning shaft relative to the tuning cap.

Figure 10:
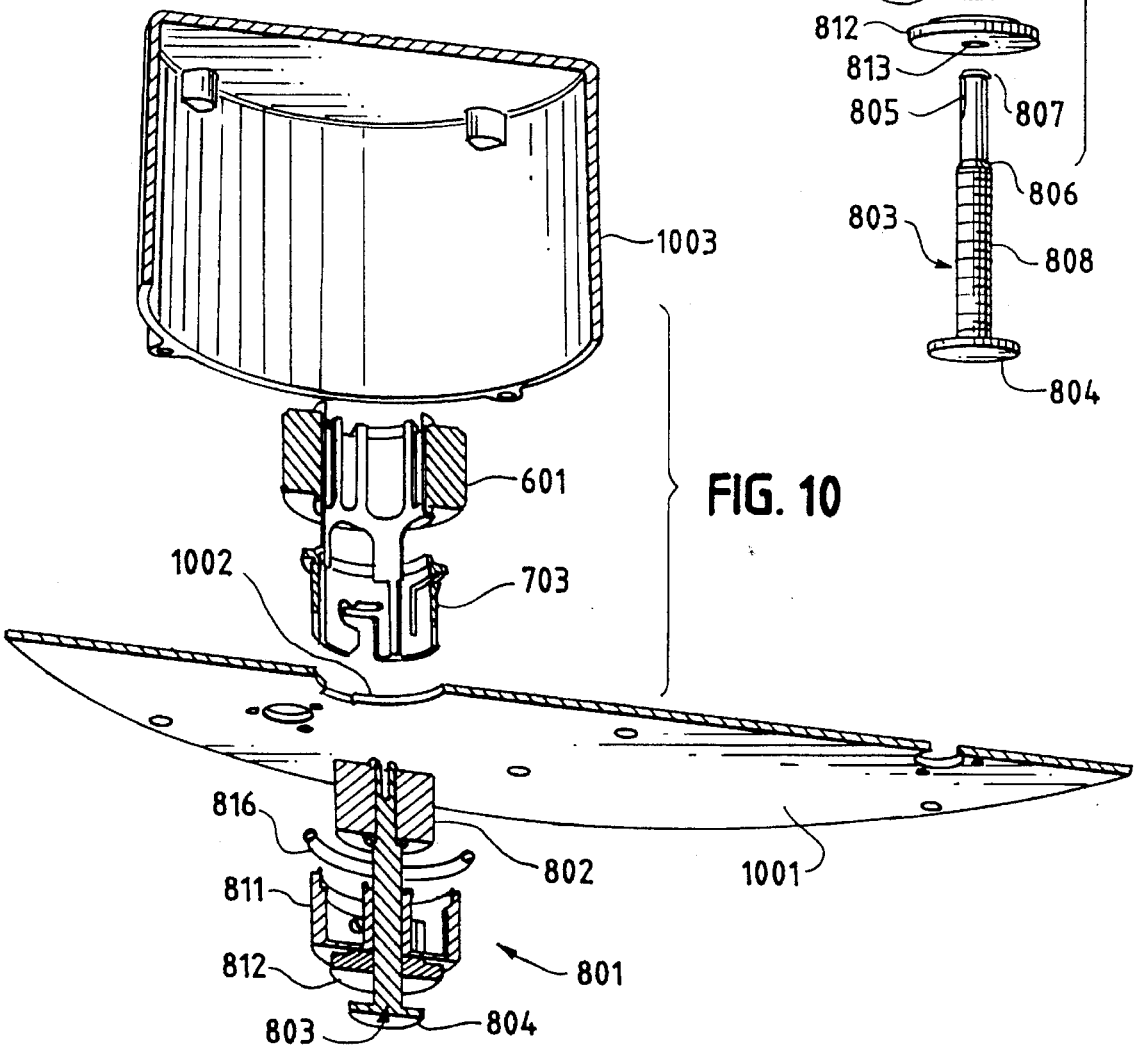
FIG. 10 is a cut away view in perspective of a tunable resonator assembly in accordance with the present invention.

FIG. 10 is a cut away view in perspective of the above-described components that illustrates the manner in which the components fit together to form a tunable filter assembly. As described above, the assembled ceramic resonator 601 and plastic support 703 are first inserted into an opening 1002 in a supporting surface 1001 of a cavity and snapped into place. Next, the resonator tuning assembly 801 is attached to the bottom portion of the plastic support, with features in the interior of the tuning cap 811 mating with cooperating features on the bottom portion of the plastic resonator support 703. Specifically, attachment is achieved through a familiar bayonet-type connection, with protruding features 815 inside the tuning cap 811 mating with slots 708 provided in the plastic support. The tuning cap 811 is then rotated slightly to seat the tuning assembly firmly. Preferably, the tuning cap 811 is formed from a conductive material, preferably aluminum, and a conductive gasket 816, such as a silicone rubber gasket with a conductive powder filler, is interposed between the tuning cap and the support surface 1001, which forms an end plate of the resonator cavity. Preferably, the conductive powder filler is silver plated aluminum powder. The conductive gasket 816, under compression, serves both to hold the plastic support 703 firmly in place, and to ensure an adequate conductive path between the support surface 1001 and the tuning cap 811.

When the components are assembled in this fashion, the tuning element 802 of the tuning assembly 801 is brought into proximity with the ceramic resonator 601. Preferably, this arrangement of components allows the tuning element 802 to extend into the interior of the ceramic resonator 601. As the plastic tuning shaft 803 is rotated, the ceramic tuning element 802 moves linearly with respect to both the tuning cap 811 and the ceramic resonator 601, thus varying the resonant frequency of the resonator. A cap 1003 of conductive material is fastened to the support surface 1001 to form a cavity for the ceramic resonator 601.

As mentioned previously, the tuning shaft is formed from a low loss plastic material that is virtually transparent at the operating frequency of the resonator. This plastic material is preferably a glass fiber reinforced polyetherimide resin. Variation of the glass fiber content affects the temperature coefficient of expansion of the plastic material, so that the temperature properties of the plastic components may be adjusted to complement or compensate for the thermal properties of the ceramic resonator or other system components to achieve desired temperature performance. For example, the plastic material may be ULTEM 2400, which has a higher glass content than ULTEM 2300, thus imparting a temperature coefficient of expansion that may make it more suitable for operation over a broader range of temperatures.

The tuning assembly 801 is adaptable to both manual and automatic tuning. In manual mode, the plastic shaft 803 may simply be rotated as described above using the knurled flattened head. For automatic tunings a motors such as a stepper motor, may be attached to the shaft 803 using a suitable coupling means, such as an opening with a flattened side in the tuning shaft mating with a flattened extension of the motor shaft, for example, for tuning the resonator assembly in accordance with well-understood methods.

In the alternative, a thread may be provided only internally of the tuning shaft. A threaded shaft from an associated stepper motor may then cooperate with this internal thread, forming a linear actuator that causes the tuning shaft to move axially of its length within the plastic support structure without requiring any rotational motion of the tuning shaft itself.

The support 703 may also be used without a tuning assembly if tuning of the resonator 601 is not deemed necessary. But the assembly can be upgraded easily to a tunable configuration if necessary, thus resulting in a retrofittable or upgradeable resonator assembly. The use of plastic materials also reduces spurious responses that are observable when ceramic or bonded support structures are utilized.

There have been described herein a plastic resonator support and resonator tuning assembly that are relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. A filter assembly comprising:

a cavity;

a substantially cylindrical dielectric resonator supported in said cavity;

a fiber filled plastic support structure, said support structure defining an integrally formed support surface and an opposed clamping surface;

said resonator being supported between and bearing against said support surface and said clamping surface;

said clamping surface and said support surface engaging opposite surfaces of said resonator, and maintaining said resonator in a predetermined relationship to said cavity;

said support structure further comprising an attachment means for fixedly positioning said support structure in said cavity;

such that said resonator remains substantially stationary with respect to said support structure and said cavity over the operating temperature range of said filter.

2. The filter of claim 1, wherein said resonator is a ceramic resonator.

3. The filter of claim 1, wherein the plastic support structure is formed from a high temperature fiber filled thermoplastic.

4. The filter of claim 3, wherein the high temperature thermoplastic is a fiber filled polyetherimide resin.

5. The filter of claim 4, wherein the fibers are glass fibers.

6. The filter of claim 5, wherein the glass fiber content of the glass fiber filled polyetherimide resin is adjusted to provide a selected temperature coefficient of expansion of the plastic support structure.

7. A filter assembly comprising:

a cavity;

a substantially cylindrical dielectric resonator supported in said cavity;

a fiber filled plastic support structure;

a support surface defined by said support structure, said resonator being supported against and bearing against said support surface;

said support structure further comprising a clamping means, said clamping means engaging a surface of said resonator remote from said support surface and maintaining said resonator against said support surface;

said support structure further comprising an attachment means for fixedly positioning said support structure in said cavity;

such that said resonator remains substantially stationary with respect to said support surface and said cavity over the operating temperature range of said filter;

said plastic support structure clamping means comprising a plurality of spaced apart arms diverging from the support surface thereof, each of the arms terminating in a cantilevered stop at a first end; and the cantilevered stops holding said dielectric resonator in a fixed relationship with respect to said support surface.

8. The filter of claim 7, wherein the dielectric resonator has an axial opening therethrough, and the spaced apart arms cooperate with the axial opening such that the spaced apart arms are deformed toward one another upon entering a proximal end of the opening, then move away from one another as the cantilevered stops exit a distal end of the opening.

9. The filter of claim 8, wherein a resilient O-ring is interposed between the support surface and the resonator.

10. A filter assembly comprising:

a cavity;

a substantially cylindrical dielectric resonator supported in said cavity;

a fiber filled plastic support structure;

a support surface defined by said support structure, said resonator being supported against and bearing against said support surface;

said support structure further comprising a clamping means, said clamping means engaging a surface of said resonator remote from said support surface and maintaining said resonator against said support surface;

said support structure further comprising an attachment means for fixedly positioning said support structure in said cavity;

such that said resonator remains substantially stationary with respect to said support surface and said cavity over the operating temperature range of said filter;

a substantially cylindrical dielectric tuning element;

an elongated plastic tuning shaft mounted for movement axially of its length and having a gripping means at one end for gripping and mounting said tuning element; and said plastic tuning shaft and said tuning element being mounted for movement within said plastic support structure to vary the resonant frequency of said filter.

11. The filter of claim 10, wherein said plastic tuning shaft is threaded along a portion of its length, and has a plurality of spaced apart members diverging from a shoulder of the plastic tuning shaft, each of the members terminating in a cantilevered stop;

the cantilevered stops holding the tuning element in a fixed relationship with respect to the plastic tuning shaft; and a substantially cylindrical tuning cap threadably engaged with the plastic tuning shaft, such that rotational motion of the tuning shaft within the tuning cap results in axial motion of the tuning element with respect to the tuning cap.

12. The filter of claim 11, wherein the tuning element has an axial opening therethrough and the spaced apart members cooperate with the axial opening such that the spaced apart members are deformed toward one another upon entering a proximal end of the opening, then move away from one another as the cantilevered stops exit a distal end of the opening.

13. The filter of claim 11, wherein a locking nut is threadably engaged with the tuning shaft in proximity to the tuning cap, the locking nut being rotated to move into contact with the tuning cap and frictionally preventing further rotation of the tuning shaft with respect to the tuning cap when a desired tuning element position has been reached.

14. The filter of claim 10, wherein a knurled flattened head is provided for imparting rotational motion to said tuning shaft.

15. The filter of claim 10, wherein the plastic tuning shaft is formed from a glass fiber reinforced polyetherimide resin.

16. The filter of claim 15, wherein the glass fiber content of the glass fiber reinforced polyetherimide resin is adjusted to provide a selected temperature coefficient of expansion of the plastic tuning shaft.

* * * * *